United States Patent [19]

Aida et al.

[11] Patent Number: 4,497,636

[45] Date of Patent: Feb. 5, 1985

[54] PROCESS FOR REMOVING SULFUR FROM COAL

[75] Inventors: Tetsuo Aida, Ames; Thomas G. Squires, Gilbert; Clifford G. Venier, Ames, all of Iowa

[73] Assignee: The United States of America as represented by the United States Department of Energy, Washington, D.C.

[21] Appl. No.: 522,277

[22] Filed: Aug. 11, 1983

[51] Int. Cl.[3] ..... C10L 9/06

[52] U.S. Cl. ..... 44/15 R; 201/17

[58] Field of Search ..... 44/15 R; 201/17

[56] References Cited

U.S. PATENT DOCUMENTS

| | | | |
|---|---|---|---|
| 3,919,118 | 11/1975 | Robinson et al. | 201/17 X |
| 4,087,514 | 5/1978 | Robinson et al. | 201/17 X |
| 4,118,200 | 10/1978 | Kruesi | 44/15 R |
| 4,183,730 | 1/1980 | Dondelewski | 44/15 R |
| 4,324,560 | 4/1982 | Fonseca | 44/15 R |
| 4,328,002 | 5/1982 | Bender | 44/15 R |

*Primary Examiner*—Carl F. Dees

*Attorney, Agent, or Firm*—James W. Weinberger; Walter L. Rees

[57] ABSTRACT

A process for the removal of divalent organic and inorganic sulfur compounds from coal and other carbonaceous material. A slurry of pulverized carbonaceous material is contacted with an electrophilic oxidant which selectively oxidizes the divalent organic and inorganic compounds to trivalent and tetravalent compounds. The carbonaceous material is then contacted with a molten caustic which dissolves the oxidized sulfur compounds away from the hydrocarbon matrix.

17 Claims, No Drawings

PROCESS FOR REMOVING SULFUR FROM COAL

CONTRACTUAL ORIGIN OF THE INVENTION

The United States Government has rights in this invention pursuant to Contract No. W-7405-ENG-38 between the U.S. Department of Energy and Ames Laboratory.

BACKGROUND OF THE INVENTION

The present invention relates to a method of removing organic and inorganic sulfur compounds from coal and other carbonaceous combustible materials.

The recent energy crisis has increased the consumption of coal in the United States. However, there are many problems which need to be solved concerning the use of coal. The most important is environmental pollution caused by burning coal.

Most coal found in the United States contains from 0.5 up to 10 weight percent sulfur. When coal is burned, the sulfur is emitted as sulfur dioxide, which causes serious pollution of the atmosphere. Moisture in the atmopshere then combines with the sulfur dioxide to produce "acid rain".

Because of the adverse impact of large quantities sulfur from burning coal on the environment, it is necessary to substantially reduce the amount of sulfur which is released to the atmosphere. Only a small fraction of the available coal can be burned directly without violating current pollution control regulations. Thus methods must be developed to either decrease the amount of sulfur in the coal before it is combusted or to remove the sulfur from the flue gas. However, flue gas desulfurization is expensive because of the high cost of the capital equipment and the high cost of maintaining that equipment. Pre-combustion processes include conventional physical cleaning, chemical treatment, magnetic separation and coal conversion such as gasification and liquefaction. Most physical cleaning methods separate mineral impurities from coal on the basis of the differences in density of coal and mineral matter. This method only removes coarse mineral partices which are easily released, while leaving the finer particles in the coal. Coal gasification and liquefaction are not yet fully developed and are expensive. Magnetic separation again can remove only liberated particles but does remove some ash forming minerals in addition to some sulfur. Chemical cleaning methods, which can remove both organic and inorganic sulfur, are more effective than physical cleaning methods and are generally more economical than gasification and liquefaction.

Sulfur, in coal, may be classified into two general types, organic and inorganic. Organic sulfur is chemically bonded to the hydrocarbon matrix of coal and can only be removed by chemical means. Inorganic sulfur is present in coal as pyrite ($FeS_2$) and in small amounts as a sulfate (generally, calcium sulfate or ferrous sulfate). Pyritic sulfur may range from 0.5 to 10.0 weight percent with individual particles of pyrite ranging from a few microns to a few inches in diameter. Large, liberated pyrite particles can be removed by hand or by various mechanical cleaning methods, but particles that are finely distributed in the coal matrix need first to be liberated by fine grinding.

A number of different processes have been developed for the removal of organic and inorganic sulfur from coal and other burnable carbonaceous materials and for reducing the ash content of these materials. One such method is known as the Gravimelt Process. The method is based on treating one part of finely powdered coal with approximately ten parts of a fused alkali (sodium hydroxide, potassium hydroxide, or a sodium hydroxide—potassium hydroxide mixture) at 300°–400° C. for 20–70 minutes. After removal of the coal floating on top of the melt and washing extensively with water to remove residual alkali and reaction products, substantial reductions in the sulfur content can be achieved. Subsequent washing of the treated coal with dilute sulfuric acid removes much of the mineral matter, leaving a product that is a relatively low-sulfur, low ash fuel. However, while the process is effective, significant amounts of organic sulfur remain in the coal, where it is burned and vented to the atmosphere as sulfuric dioxide.

In another process for removing sulfur, a slurry of finely divided coal in a solvent of methylchlorform, carbon tetrachloride or tetrachlorethylene and 30–70 weight percent water is prepared. Gaseous chlorine is bubbled through the slurry at 60°–130° C. and 0–60 psig from 45 to 90 minutes to oxidize the coal. The process will remove about 60% of total sulfur in the coal, removing about 50% of the organic sulfur and 70% of the pyritic sulfur. While the process is reasonably effective, about half of the organic sulfur remains in the coal. Furthermore, substantial amounts of residual chlorine remain in the cleaned coal which can produce highly corrosive combustion products upon burning.

What is needed is a process for the removal of organic sulfur from combustible carbonaceous material such as coal, which is at least as effective as are processes for removing inorganic sulfur from the coal.

SUMMARY OF THE INVENTION

It has been found that most of the sulfur present in coal, both organic and inorganic, is in the divalent state. Furthermore, it has been found that the divalent organic sulfur compounds found in coal, generally believed to be thiophenols, aryl sulfides and thiophenes, are very stable and generally not affected by most of the processes for removing sulfur from coal. However, if these divalent sulfur compounds are oxidized to the trivalent and tetravalent state, removal of the compounds becomes much easier and more complete, and furthermore, the compounds can be removed under less drastic conditions compared to other processes utilized for removing sulfur from the coal reducing the energy loss from the coal. Degradation of the coal is reduced because there is less oxidation of the hydrocarbon matrix.

The invention is a process for removing divalent organic and inorganic sulfur compounds from combustible organic carbonaceous material, by contacting the finely divided material with an electrophilic oxidant to selectively oxidize the divalent organic and inorganic sulfur compounds to trivalent and tetravalent organic and inorganic sulfur compounds, separating the carbonaceous material containing the oxidized sulfur compounds from the oxidant, contacting the carbonaceous material with a molten caustic to dissolve the trivalent and tetravalent organic and inorganic sulfur compounds and to neutralize any oxidant remaining in the material, thereby removing the sulfur compounds from the carbonaceous material, separating the carbonaceous material from the molten caustic, and removing any remaining caustic from the material.

It is therefore one object of the invention to provide an improved process for removing sulfur from carbonaceous material.

It is another object of the invention to provide an improved process for the removal of organic sulfur from carbonaceous material.

Finally it is the object of the invention to provide an improved process for the removal of divalent organic and inorganic sulfur compounds from carbonaceous materials such as coal.

DETAILED DESCRIPTION OF THE INVENTION

These and other objects of the invention may be met by pulverizing the carbonaceous material to about 200 to 400 (U.S.) mesh size particles, subjecting the pulverized particles to a physical beneficiation to remove some of the mineral matter and pyritic sulfur present in the carbonaceous material, forming a slurry of the beneficiated carbonaceous material in water and an organic solvent of methylene chloride in a ratio of water to solvent of about 1:2, bubbling chlorine gas through the slurry to selectively oxidize the divalent organic and inorganic sulfur compounds to trivalent and tetravalent sulfur compounds, separating the carbonaceous material containing the oxidized sulfur compounds from the slurry containing the oxidant, contacting the carbonaceous material with a molten caustic of sodium hydroxide in a ratio of about one part carbonaceous material to about ten parts caustic at about 300°–350° C. for about 30 minutes to selectively dissolve the trivalent and tetravalent organic and inorganic sulfur compounds, thereby removing the sulfur from the carbonaceous material, and to neutralize any oxidant which may remain in the carbonaceous material, separating the desulfurized carbonaceous material from the molten caustic and washing the carbonaceous material to remove and neturalize any caustic remaining in the carbonaceous material.

The method of the invention is suitable for use with burnable carbonaceous materials such as bituminous and subbituminous coal. The material is preferably pulverized to between 200 and 400 mesh (U.S. mesh sizes) although as particles large as 25 mesh are satisfactory. Pulverization aids slurrying and improves the accessibility of the sulfur compounds for oxidation.

Preferably the pulverized material is subjected to physical benefication to remove mineral matter and pyritic sulfur. The removal of pyritic sulfur is important to prevent the use of excessive oxidant, which is generally expensive, because pyritic sulfur requires large amounts of oxidant. For example, the oxidation of 2 mols of $FeS_2$ requires 15 mols of chlorine. Physical benefication of the carbonaceous material may be accomplished by any of several methods known to those skilled in the art, such as, for example, specific gravity separation, froth floatation or oil agglomeration.

After completion of benefication, a slurry is formed of the carbonaceous material. The choice of slurry liquid will depend upon the choice of oxidant.

The oxidant is preferably electrophilic because electrophilic oxidants are more selective for oxidizing divalent organic and inorganic sulfur compounds in coal. The choice of an electrophilic oxidant together with relatively mild oxidizing conditions reduces the chances of oxidizing the hydrocarbon matrix which would ultimately reduce the energy value of the carbonaceous material. The preferred oxidant is chlorine gas which is bubbled through the slurry. Preferably, the slurry liquid may be either water or a mixture of water and a liquid organic solvent, although in some instances it may be an organic solvent alone. The solvent must be one which doesn't significantly affect the oxidizing power of the oxidant. Examples are methylchloroform, carbon tetrachloride, tetrachloroethylene, methylene chloride, and pure acetic acid. The addition of the solvent facilitates the reaction of the oxidant with the sulfur. The ratio of water to solvent is not known to be critical and may vary in all proportions. Other electrophilic oxidants may suitably include bromine solution in water or a water-organic solvent mixture, hydrogen peroxide in a mineral acid such as sulfuric acid or phosphoric acid or hydrogen peroxide in an organic acid such as acetic acid or propionic acid. Preferably the amount of oxidant is from about one to four equivalents relative to the divalent organic and inorganic sulfur present in the carbonaceous material, although an excess may be necessary to ensure complete oxidation. Atmospheric pressure is satisfactory although elevated pressures may be present. Similarly, temperature is not critical and may vary from room or ambient temperature up to about 100° C. The reaction rate is rapid and times may vary from a few minutes up to an hour or more but must be sufficient to oxidize the divalent sulfur compounds to the trivalent and tetravalent states. In general, reaction conditions are kept mild in order to limit oxidation to primarily the sulfur compounds and to prevent or limit oxidation of other compounds present in the carbonaceous material.

After oxidation is complete, the carbonaceous material is separated from the slurry liquid and preferably dried.

The carbonaceous material is then contacted with a molten caustic to dissolve the oxidized sulfur compounds and also to neutralize any oxidant which may remain in the material which could otherwise form a corrosive compound during combusion. The molten caustic may be either potassium hydroxide, sodium hydroxide or a mixture of potassium and sodium hydroxides. Temperature may vary from about 250° to 400° C. with about 325° C. being preferred since higher temperatures may result in excess charing of the carbonaceous material with an attendent loss of energy value. Times must be sufficient to dissolve the soluble sulfur compounds and may vary from 15 minutes to about one hour with the shorter times generally being sufficient. The ratio of carbonaceous material to caustic may vary from 1:2 to 1:30 with a 1:10 ratio preferred.

Once all the oxidized sulfur has been solubilized into the caustic, the carbonaceous material may be separated from the caustic and washed with water or alternatively, with a dilute acid to neutralize the caustic.

The process of the invention has been found effective for the removal of up to about 90% of the total sulfur present in coal.

The following Examples are given to illustrate the invention and are not to be taken as limiting the extent of the invention which is defined by the appended claims.

EXAMPLE I

The oxidation of organic sulfur compounds, was studied by preparing a mixture of 100 mg of dibenzothiophene, 2.0 ml of water and 4.0 ml of $CH_2Cl_2$. Dibenzothiophene was used because of the organic sulfur functionalities which have been detected in coal, it is the least reactive toward electrophilic oxidants. The mixture was stirred in a small flask; and $Cl_2$ was bubbled into the mixture for 10 minutes. The residual $Cl_2$ and the $CH_2Cl_2$ were removed under aspiration, and approximately 1.0 ml of saturated $Na_2SO_3$ solution was added to discharge the chlorine. The resulting mixture was then extracted three times with 7.0 ml of $CH_2Cl_2$, and the $CH_2Cl_2$ solution was washed with $NaHCO_3$ solution. After drying the solution over $Na_2SO_4$, it was analyzed by gas chromatography using phenyl sulfide as an internal standard. The analysis showed that under the mild reaction conditions, 63% of the dibenzothiophene was oxidized to dibenzothiophene-5-oxide and 15% was oxidized to dibenzothiophene-5,5-dioxide.

EXAMPLE II

A series of experiments were made to react various organic sulfur compounds with molten potassium hydroxide. In a typical experiment, 200 mg of KOH and 0.15 moles of the organic sulfur compound was immersed for 10 minutes in a $KNO_3$ salt bath at the appropriate temperature (200°-350° C.). The ampule was then retrieved, cooled to room temperature, opened, and the contents extracted with 5 ml $CH_2Cl_2$. The residual solid was dissolved in 5.0 ml of water and combined with the $CH_2Cl_2$ solution, acidification with 6N $H_2SO_4$ and separation of the layers was followed by extraction of the aqueous layer with two additional portions of $CH_2Cl_2$. The combined $CH_2Cl_2$ solution was dried over $Na_2SO_4$ and analyzed by gas chromatography, infared and nuclear magnetic resonance. Results of these experiments are shown in Table I.

TABLE I

| Compound | Recovered Starting Material at Indicated Condition (%) | | |
|---|---|---|---|
| | 200° C., 10 min. | 250° C., 10 min. | 350° C., 10 min. |
| Dibenzothiophene | 100 | 100 | 100 |
| Phenyl Sulfide | — | — | 100 |
| Phenyl benzyl sulfide | — | — | 0 |
| Dibenzothiophene-5-oxide | — | — | 0 |
| Dibenzothiophene-5,5-dioxide | 88 | 22 | 0 |
| Thiophenol | — | — | 100 |
| 2-Phenylbenzenesulfonic Acid | — | 98[a] | 12[a] |

[a]Maximum value based on quantitative analysis of 2-phenylphenol product.

From these results, it is clear that, in general, oxidized sulfur functions are substantially more reactive toward molten KOH than the reduced, divalent sulfur species.

EXAMPLE III

A mixture of 3.0 g of West Kentucky No. 9 coal, 10.0 ml of water, and 20.0 ml of methylene chloride was stirred vigorously at room temperature for one hour while $Cl_2$ was bubbled through the mixture. The residual $Cl_2$ and the $CH_2Cl_2$ was then removed by aspiration before adding 150 ml of water to the reaction mixture. The resulting slurry was heated to 60° C. and maintained at that temperature for 2 hours with occassional shaking. After filtering and washing with fresh water, the coal was dried under vacuum (0.01 mm Hg, 70° C., 2 hours). The coal was analyzed for sulfur and chlorine content. The analysis before and after treatment are shown in Table II below. It might be noted that even under these relatively mild conditions, substantial amounts of chlorine were incorporated into the coal, probably via electrophilic aromatic substitution. The sulfur reduction in the treated coal accounts for 53% sulfur removal if a correction is made for the increased sample weight due to chlorine incorporation. Within experimental error, this reduction corresponds to complete removal of the pyritic sulfur.

EXAMPLE IV

Both the untreated W. Kentucky coal and the coal which had been treated with $Cl_2$ were reacted with KOH as follows. A mixture of 500 mg of coal and 15.0 g of KOH were placed in a stainless steel mini-reactor equipped with a $N_2$ purge and mechanical stirrer. After purging the apparatus for 15 minutes, the reactor was immersed into a $KNO_3$ salt bath at 400° C., and the reaction mixture was stirred for 20 minutes. The molten mixture was removed from the salt bath and quickly poured into a 500 ml Erlenmeyer flask. After cooling, the reactor was rinsed with 100 ml of water which was added to the cooled KOH reaction mixture. The resulting mixture was rendered slightly acidic with concentrated HCl, diluted with 150 ml of water, and warmed to 60° C. This mixture was maintained at 60° C. for one hour with occasional shaking. Then the coal was filtered, washed thoroughly with water, and dried under vacuum (0.01 mm Hg, 100° C., overnight). The resulting coal material was analyzed for sulfur and chlorine. A comparison of the sulfur and chlorine contents of the starting materials and products from these experiments are presented in Table II below.

TABLE II

| Sample Description | Total S (Wt %) | Pyritic S (Wt %) | Organic S (Wt %) | Chlorine (Wt %) |
|---|---|---|---|---|
| Raw Coal | 3.47 | 1.68 | 1.77 | 0.03 |
| Coal/$Cl_2$ | 1.33 | — | — | 25.65 |
| Coal/KOH | 1.30 | — | — | — |
| Coal/$Cl_2$/KOH | 0.42 | — | — | 0.03 |

The process of the invention removed 88% of the total sulfur content of the coal while the molten caustic treatment alone removed 62% of the sulfur and the chlorine treatment alone removed 53% of the total sulfur. It might also be noted that treatment of the chlorinated coal with molten caustic is a very effective method for removing residual chlorine or other oxidants from the carbonaceous material.

The embodiments of this invention in which an exclusive property or privilege is claimed are defined as follows:

1. A process of removing divalent organic and inorganic sulfur compounds from carbonaceous material consisting essentially of:

contacting the finely divided carbonaceous material, as a slurry in a slurry liquid, with an electrophyllic oxidant to selectively oxidize the divalent organic and inorganic sulfur compounds to trivalent and tetravalent organic and inorganic sulfur compounds, the oxidant being selected from the group consisting of chlorine, bromine, and hydrogen peroxide, separating the carbonaceous material containing the oxidized organic and inorganic sulfur compounds from the oxidant;

contacting the carbonaceous material with a molten caustic to dissolve the trivalent and tetravalent organic and inorganic compounds and to neutralize any oxidant remaining in the material, thereby separating the sulfur compounds from the carbonaceous material;

separating the carbonaceous material from the molten caustic; and removing any caustic remaining in the carbonaceous material.

2. The method of claim 1 including the additional step of beneficiating the carbonaceous material to remove some of inorganic pyritic sulfur before contacting the material with the oxidant.

3. The process of claim 2 wherein a slurry is formed of the beneficiated material and a slurry liquid of water and the oxidant is selected from the group consisting of chlorine and bromine.

4. The process of claim 2 wherein the slurry is formed of the beneficiated material and a slurry liquid, the slurry liquid being an acid selected from the group consisting of sulfuric acid, phosphoric acid, acetic acid and propionic acid and the oxidant is hydrogen peroxide.

5. The process of claim 3 wherein the slurry also contains a liquid organic solvent, said solvent being one which does not significantly affect the oxidizing power of the oxidant.

6. The method of claim 5 wherein the molten caustic is selected from the group consisting of potassium hydroxide, sodium hydroxide and mixtures thereof.

7. The method of claim 6 wherein the oxidized carbonaceous material is contactd with the molten caustic at a temperature of 250° to 400° C. for a period of about 15 minutes to 1 hour.

8. The process of claim 7 wherein the organic solvent is selected from the group consisting of methylchloroform, carbon tetrachloride, tetrachloroethylene and methylene chloride and the ratio of water to solvent is 1:2.

9. The process of claim 8 wherein the electrophilic oxidant is chlorine.

10. The method of claim 9 wherein the caustic remaining in the carbonaceous material is removed by washing the material with water after separation from the molten caustic.

11. The process of claim 10 wherein the caustic remaining in the carbonaceous material is removed by neutralization with a mineral acid.

12. A process for removing divalent organic and inorganic sulfur compounds from organic carbonaceous material comprising:

physically beneficiating finely divided carbonaceous material to remove some pyritic sulfur and minerals, forming a slurry of the finely divided beneficiated carbonaceous material with a slurry liquid of water and an organic solvent selected from the group of methylchloroform, carbon tetrachloride, tetrachloroethylene and methylene chloride, the ratio of water to solvent being about 1:2, bubbling chlorine gas through the slurry for a period of time sufficient to oxidize the divalent organic and inorganic sulfur compounds in the carbonaceous material to trivalent and tetravalent compounds, separating the carbonaceous material containing the oxidized sulfur compounds from the slurry liquid, contacting the carbonaceous material with a molten caustic selected from the group of sodium hydroxide, potassium hydroxide and mixtures thereof of a temperature from 300° to 350° C. for a period of time sufficient to dissolve the trivalent and tetravalent sulfur compounds away from the carbonaceous material into the caustic, and to neutralize any oxidant remaining in the carbonaceous material, the ratio of carbonaceous material to caustic being from about 1:4 to 1:10, separating the carbonaceous material from the molten caustic containing the sulfur compounds and, removing the caustic from the carbonaceous material, thereby separating the divalent organic and inorganic sulfur compounds from the carbonaceous material.

13. The process of claim 12 wherein solvent is methylene chloride and the carbonaceous material containing the oxidized sulfur is contacted with the molten caustic at about 350° C.

14. The method of claim 4 wherein the molten caustic is selected from the group consisting of potassium hydroxide, sodium hydroxide and mixtures thereof.

15. The process of claim 14 wherein the oxidized carbonaceous material is contacted with the molten caustic at a temperature of 250° to 400° C. for a period of about 15 minutes to 1 hour.

16. The method of claim 15 wherein the caustic remaining in the carbonaceous material is removed by washing the material with water after separation from the molten caustic.

17. The process of claim 15 wherein the caustic remaining in the carbonaceous material is removed by neutralization with a mineral acid.

* * * * *